US008998649B2

(12) United States Patent
Lam et al.

(10) Patent No.: US 8,998,649 B2
(45) Date of Patent: Apr. 7, 2015

(54) SERIAL ELECTRICAL CONNECTOR

(71) Applicant: SAE Magnetics (H.K.) Ltd., Hong Kong (HK)

(72) Inventors: Fuk Ming Lam, Hong Kong (HK); Francis Guillen Gamboa, Hong Kong (HK); Vincent Wai Hung, Hong Kong (HK); Dennis Tak Kit Tong, Hong Kong (HK)

(73) Assignee: SAE Magnetics (H.K.) Ltd., Hong Kong (HK)

( * ) Notice: Subject to any disclaimer, the term of this patent is extended or adjusted under 35 U.S.C. 154(b) by 46 days.

(21) Appl. No.: 13/794,798

(22) Filed: Mar. 12, 2013

(65) Prior Publication Data

US 2013/0244485 A1 Sep. 19, 2013

Related U.S. Application Data

(60) Provisional application No. 61/610,469, filed on Mar. 14, 2012.

(51) Int. Cl.

| | |
|---|---|
| ***H01R 24/04*** | (2006.01) |
| ***H01R 24/58*** | (2011.01) |
| *H01R 9/05* | (2006.01) |

(52) U.S. Cl.
CPC . *H01R 24/58* (2013.01); *H01R 9/05* (2013.01)

(58) Field of Classification Search
CPC ..... H01R 24/58
USPC ..... 439/668, 669
See application file for complete search history.

(56) References Cited

U.S. PATENT DOCUMENTS

| | | | | |
|---|---|---|---|---|
| 7,198,504 | B2 | 4/2007 | Chien et al. | |
| 7,824,228 | B1 * | 11/2010 | Yang et al. | 439/668 |
| 8,287,315 | B2 * | 10/2012 | Montena | 439/669 |
| 2004/0242076 | A1 * | 12/2004 | Nakai et al. | 439/668 |
| 2010/0190382 | A1 | 7/2010 | Szini et al. | |

* cited by examiner

*Primary Examiner* — Phuong Dinh

(57) ABSTRACT

A serial electrical connector includes a connector plug and a connector jack. The connector plug includes an audio plug with a hollow cylindrical space formed in the center thereof; a coaxial cable being inserted into and filling the space; and an engagement element being disposed at a tip of the audio plug and configured to electrically connect the audio plug to the connector jack.

20 Claims, 8 Drawing Sheets

SERIAL ELECTRICAL CONNECTOR

CROSS-REFERENCE TO RELATED APPLICATIONS

Figure 1A:
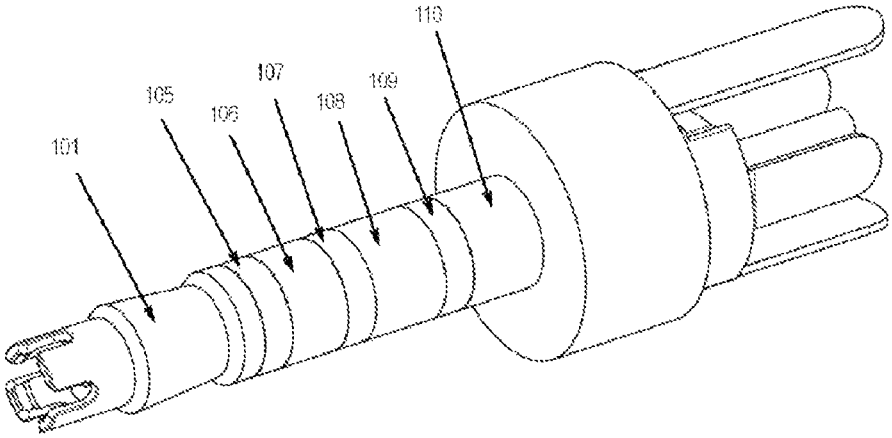

This application claims the benefit of U.S. Provisional Patent Application No. 61/610,469 filed on Mar. 14, 2012; the contents of which is hereby incorporated by reference.

FIELD OF THE PATENT APPLICATION

The present patent application generally relates to electrical connectors and more specifically to a serial electrical connector that provides a high-speed electrical serial link utilizing the form factor of an audio port.

BACKGROUND

For portable devices, low-speed and high-speed signals are handled typically by different cables and connectors. For example, audio ports are for audio signals, USB ports are for USB 2.0 signals and HDMI ports are for high-speed video signals. However, it is desired to put both low-speed and high-speed signals together in one single cable so as to help in further downsizing the portable devices.

SUMMARY

The present patent application is directed to a serial electrical connector. In one aspect, the serial electrical connector includes a connector plug and a connector jack. The connector plug includes an audio plug with a hollow cylindrical space formed in the center thereof; a coaxial cable being inserted into and filling the space; and an engagement element being disposed at a tip of the audio plug and configured to electrically connect the audio plug to the connector jack.

The coaxial cable may include a conductor, an insulator layer surrounding the conductor, and a conductive shield surrounding the insulator layer. The connector plug may further include at least three metal contacts surrounding the coaxial cable. One of the metal contacts may be physically connected with the conductive shield of the coaxial cable. A typical example is that the connector plug includes four metal contacts surrounding the coaxial cable, and the four metal contacts correspond respectively to "tip", "ring, "ring" and "sleeve" of a standard TRRS audio plug structure.

The connector plug may further include a non-conductive housing surrounding the coaxial cable. The connector plug may further include a layer of conductive material surrounding the coaxial cable, the layer of conductive material being in contact with the conductive shield of the coaxial cable.

The connector jack may be enclosed by a non-conductive housing and supported by a supporting structure. The connector jack may include a plurality of metal contacts configured for engaging with the metal contacts of the connector plug respectively. The connector jack may further include an extension cable, the extension cable being connected with the coaxial cable in the connector plug. The connector jack may include an interconnect block and a RF connector while a coaxial structure is embedded inside them. The RF connector is also configured for engaging with the plug engagement element and being electrically connected with the coaxial cable.

In another aspect, the present patent application provides a connection assembly including an extending cable and a serial electrical connector plug attached to an end of the extending cable. The connector plug includes an audio plug with a hollow cylindrical space formed in the center thereof, a coaxial cable being inserted into and filling the space, and an engagement element being disposed at a tip of the audio plug and configured to electrically connect the audio plug to a connector jack. The coaxial cable is connected to the extending cable forming a continuous waveguide.

The extended cable may include a coaxial cable in the center and at least three wires surrounding the coaxial cable, the coaxial cable of the extended cable being connected with the coaxial cable of the connector plug. The connector plug may further include at least three metal contacts surrounding the coaxial cable thereof, the metal contacts of the connector plug being connected with the wires of the extended cable. The coaxial cable of the extended cable may include a core metal, an insulator or dielectric layer surrounding the core metal, a metal shielding layer surrounding the insulator or dielectric layer, and a coaxial cable jacket surrounding the shielding layer.

In yet another aspect, the present patent application provides a serial electrical connector plug including: an audio plug with a hollow cylindrical space formed in the center thereof; a coaxial cable being inserted into and filling the space; and an engagement element being disposed at a tip of the audio plug and configured to electrically connect the audio plug to a connector jack.

The serial electrical connector plug may further include at least three metal contacts surrounding the coaxial cable. The coaxial cable may include a conductor, an insulator layer surrounding the conductor, and a conductive shield surrounding the insulator layer. One of the metal contacts may be physically connected with the conductive shield of the coaxial cable. The serial electrical connector plug may further include four metal contacts surrounding the coaxial cable. The four metal contacts may correspond respectively to "tip", "ring, "ring" and "sleeve" of a standard TRRS audio plug structure.

The serial electrical connector plug may further include a non-conductive housing surrounding the coaxial cable. The serial electrical connector plug may further include a layer of conductive material surrounding the coaxial cable. The layer of conductive material may be in contact with the conductive shield of the coaxial cable.

BRIEF DESCRIPTIONS OF THE DRAWINGS

FIG. 1*a* is a perspective view of a serial electrical connector plug according to an embodiment of the present patent application.

Figure 1B:
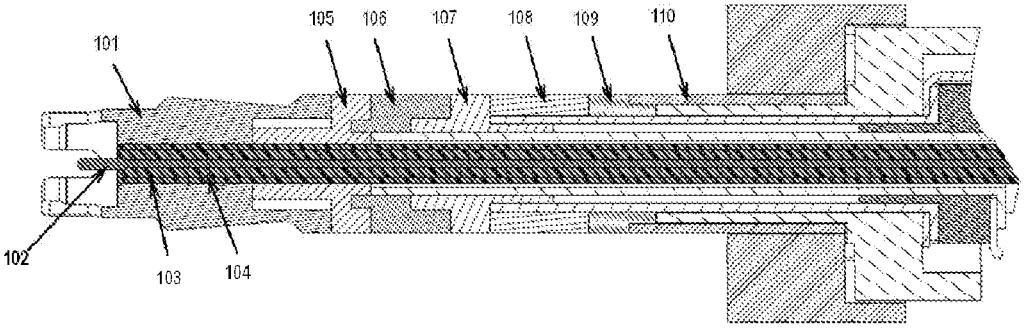

FIG. 1*b* is a cross-sectional view of the serial electrical connector plug depicted in FIG. 1*a*.

Figure 2A:
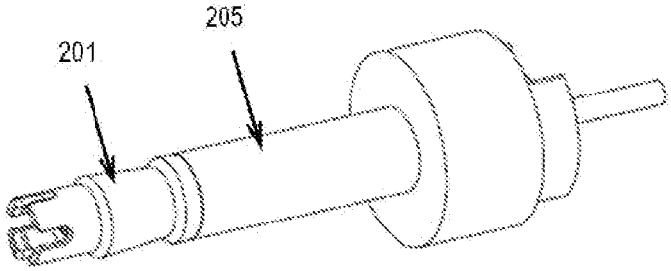

FIG. 2*a* is a perspective view of a serial electrical connector plug according to another embodiment of the present patent application.

Figure 2B:
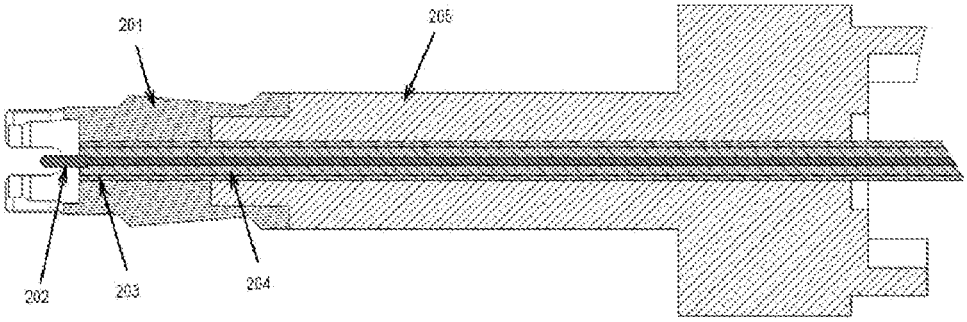

FIG. 2*b* is a cross-sectional view of the serial electrical connector plug depicted in FIG. 2*a*.

Figure 2C:
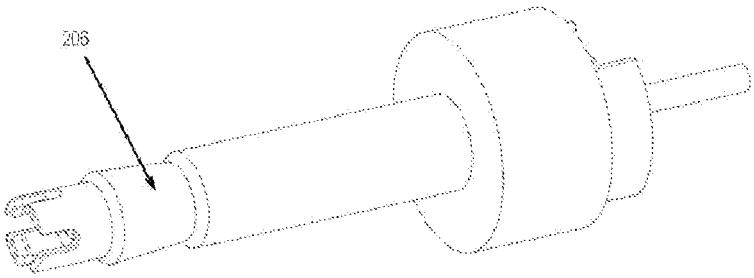

FIG. 2*c* is a perspective view of a serial electrical connector plug according to another embodiment of the present patent application.

Figure 2D:
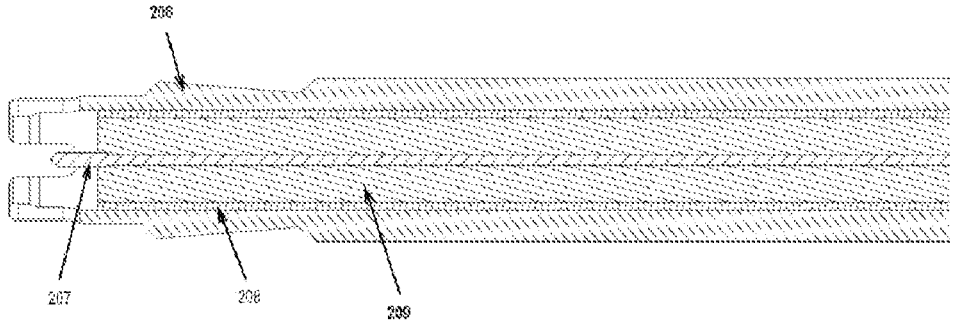

FIG. 2*d* is a cross-sectional view of the serial electrical connector plug depicted in FIG. 2*c*.

Figure 3A:
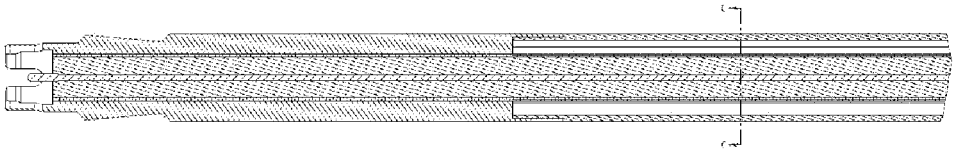

FIG. 3*a* illustrates an assembly of a coaxial cable and a serial electrical connector plug according to another embodiment of the present patent application.

Figure 3B:
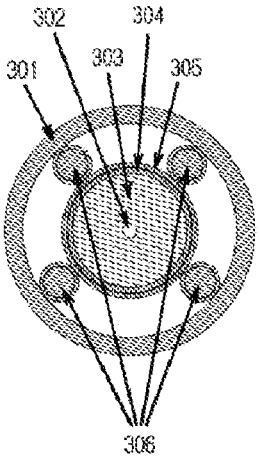

FIG. 3*b* is a cross-sectional view of the coaxial cable taken along the line C-C of FIG. 3*a*.

Figure 4A:
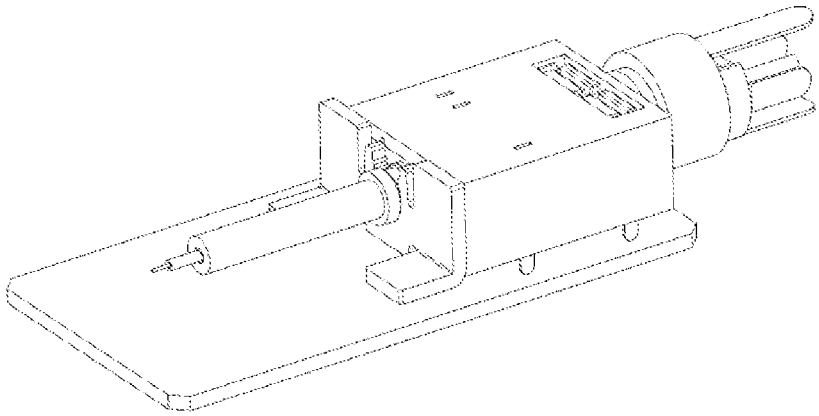

FIG. 4*a* is a perspective view of a serial electrical connector jack configured to be used with the serial electrical connector plug according to another embodiment of the present patent application.

Figure 4B:
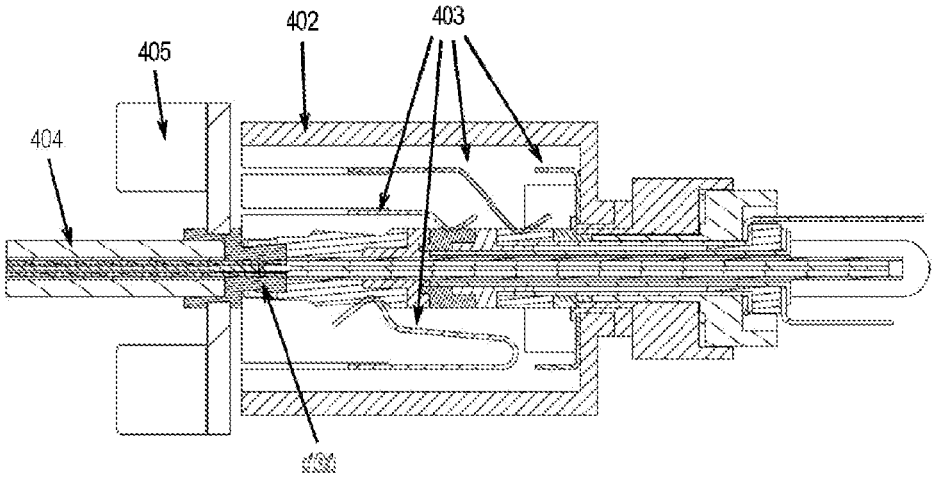

FIG. 4*b* is a top cross-sectional view of the serial electrical connector jack depicted in FIG. 4*a*.

Figure 5A:
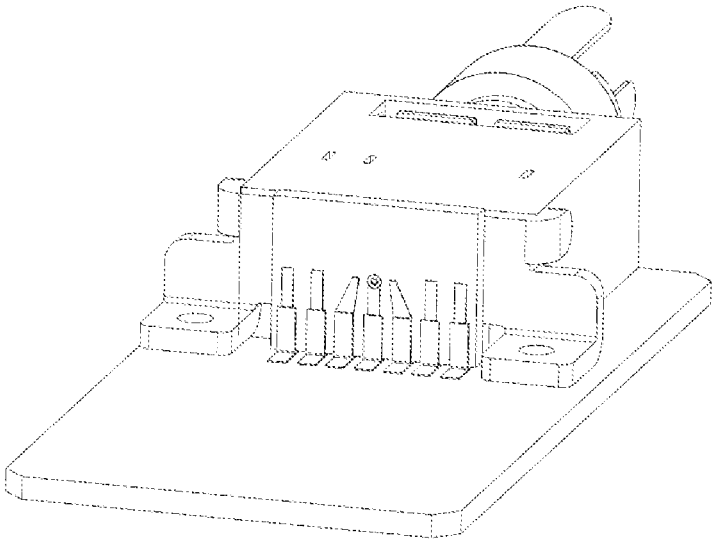

FIG. 5*a* is a perspective view of a serial electrical connector jack configured to be used with the serial electrical connector plug according to another embodiment of the present patent application.

Figure 5B:
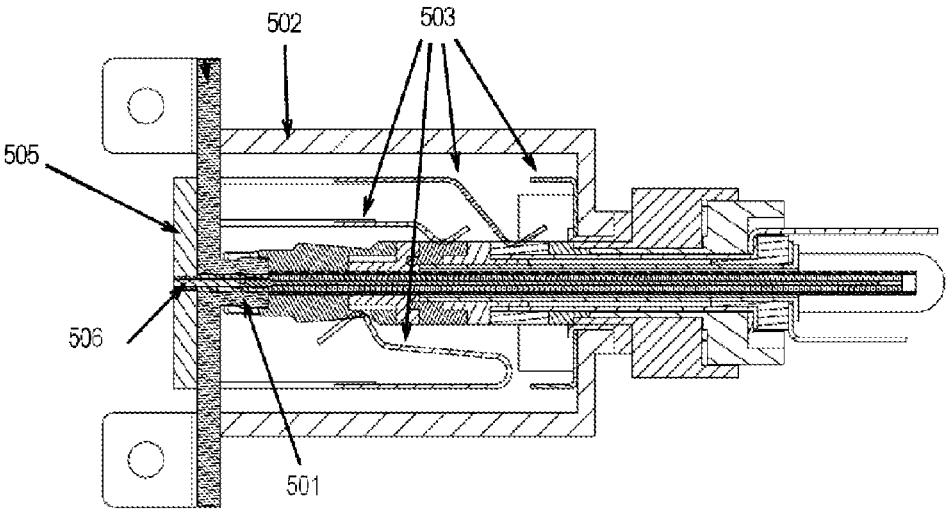

FIG. 5*b* is a top cross-sectional view of the serial electrical connector jack depicted in FIG. 5*a*.

Figure 5C:
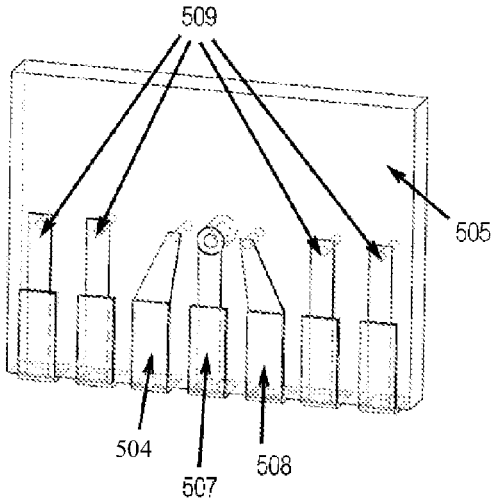

FIG. 5*c* is a perspective view of the interconnect block in the serial electrical connector jack depicted in FIG. 5*a*.

Figure 6:
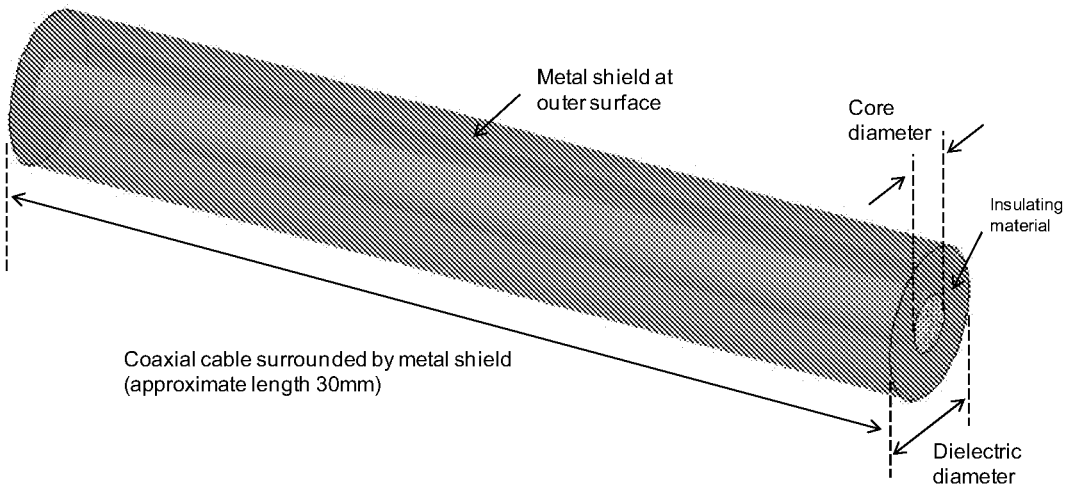

FIG. 6 is an overview of the coaxial cable inside the serial electrical connector plug in the embodiments depicted in FIGS. 1*a*-1*b* and FIGS. 2*a*-2*d*.

Figure 7A:
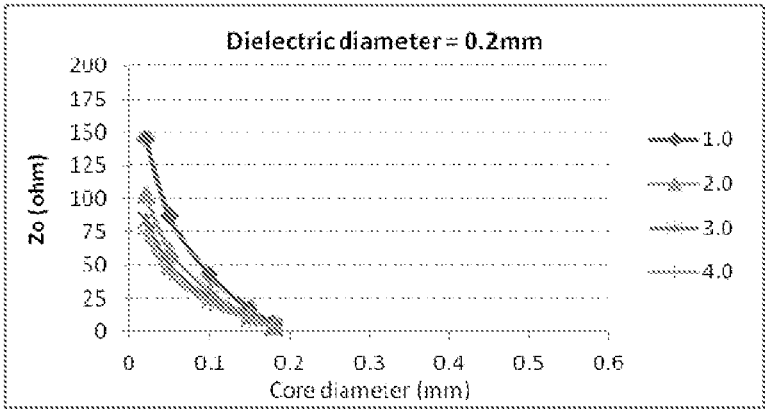

FIG. 7*a* is a plot of the characteristic impedance of the coaxial cable versus the core conductor diameter, when the diameter of the dielectric material=0.2 mm.

Figure 7B:
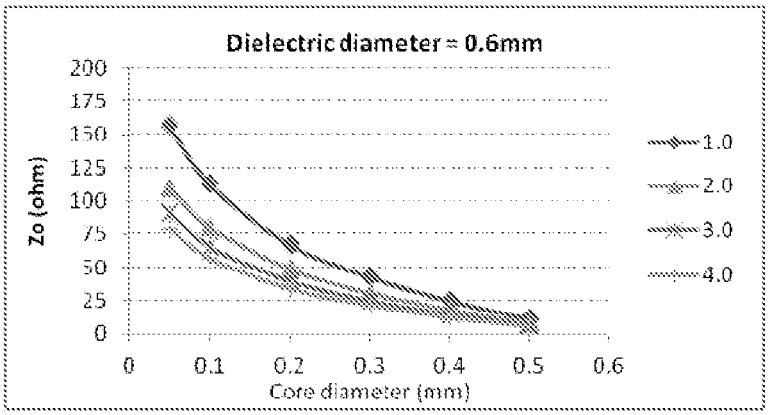

FIG. 7*b* is a plot of the characteristic impedance of the coaxial cable versus the core conductor diameter, when the diameter of the dielectric material=0.6 mm.

Figure 7C:
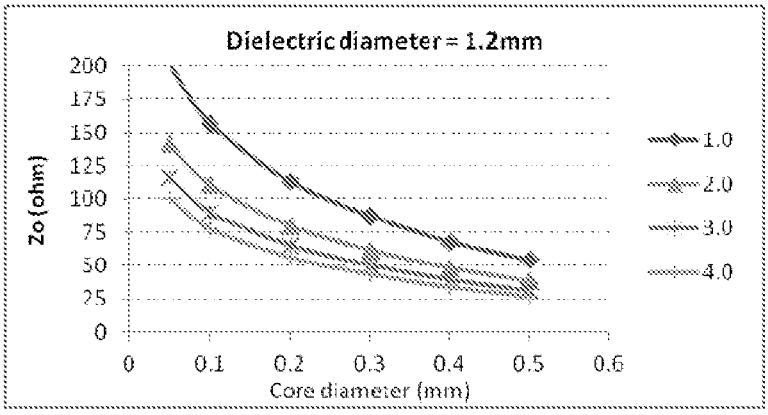

FIG. 7*c* is a plot of the characteristic impedance of the coaxial cable versus the core conductor diameter, when the diameter of the dielectric material=1.2 mm.

Figure 7D:
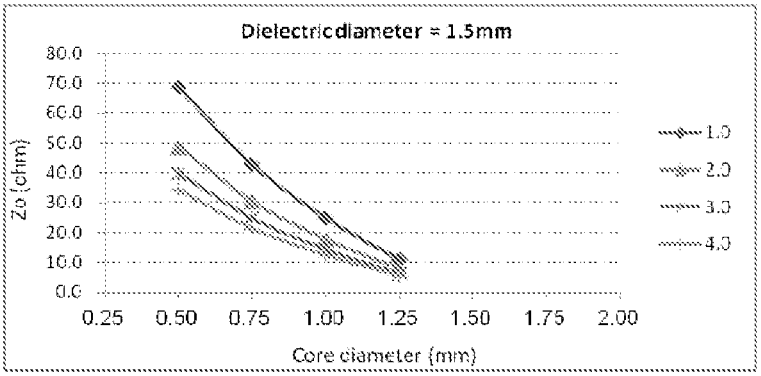

FIG. 7*d* is a plot of the characteristic impedance of the coaxial cable versus the core conductor diameter, when the diameter of the dielectric material=1.5 mm.

Figure 7E:
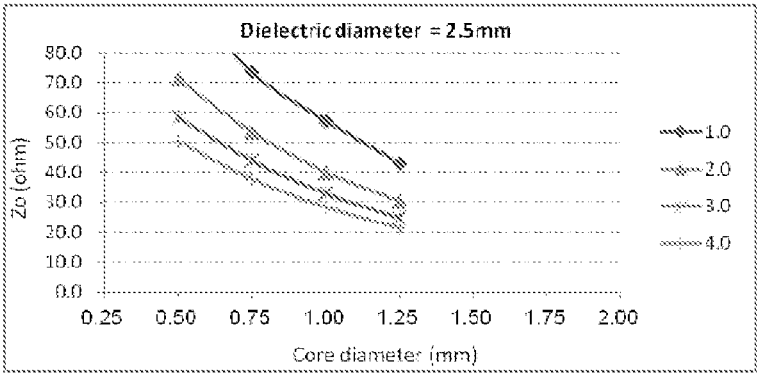

FIG. 7*e* is a plot of the characteristic impedance of the coaxial cable versus the core conductor diameter, when the diameter of the dielectric material=2.5 mm.

Figure 7F:
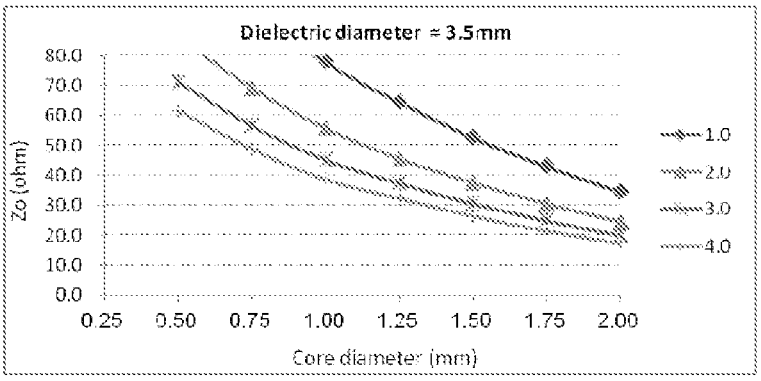

FIG. 7*f* is a plot of the characteristic impedance of the coaxial cable versus the core conductor diameter, when the diameter of the dielectric material=3.5 mm.

DETAILED DESCRIPTION

Reference will now be made in detail to a preferred embodiment of the serial electrical connector disclosed in the present patent application, examples of which are also provided in the following description. Exemplary embodiments of the serial electrical connector disclosed in the present patent application are described in detail, although it will be apparent to those skilled in the relevant art that some features that are not particularly important to an understanding of the serial electrical connector may not be shown for the sake of clarity.

Furthermore, it should be understood that the serial electrical connector disclosed in the present patent application is not limited to the precise embodiments described below and that various changes and modifications thereof may be effected by one skilled in the art without departing from the spirit or scope of the protection. For example, elements and/or features of different illustrative embodiments may be combined with each other and/or substituted for each other within the scope of this disclosure.

FIG. 1*a* is a perspective view of a serial electrical connector plug according to an embodiment of the present patent application. By being compatible with the conventional audio plug design, such as TRS and TRRS audio plugs, the plug is surrounded by at least three circular metal contacts. In this embodiment, there are four circular metal contacts: metal contacts 101, 106, 108 and 110 corresponding respectively to "tip", "ring, "ring" and "sleeve" of the standard TRRS audio plug structure. Although the tip of the metal contact 101 shows part of the engagement feature (also referred to as the engagement element), the engagement feature is not the only way of implementation, while the placement of the engagement feature at the plug tip facilitates backward compatibility to the conventional TRS type audio plug. The serial electrical connector plug supports both high-speed/RF and low-speed signal transmissions.

FIG. 1*b* is a cross-sectional view of the serial electrical connector plug depicted in FIG. 1*a*. The coaxial cable is formed by the conductor 102, the conductive shield 103 and the insulator (layer) 104, placed at the center of the serial electrical connector plug. The conductor 102 is a piece of thin metal wire surrounded by the insulator 104. The conductive shield 103 is a conductive layer surrounding the insulator 104. The Conductive shield 103 also provides ground reference to the coaxial cable to support high-speed/RF electrical signal transmission. The metal contact 101 and the conductive shield 103 are physically connected, so that the ground reference can be extended from the plug to the jack via the engagement feature on 101, which will be described in more detail hereafter with the illustration of FIG. 4*b* and FIG. 5*b*.

Referring to FIGS. 1*a*-1*b*, the items 105, 107 and 109 are insulators isolating the metal contacts 101, 106, 108 and 110. Contacts attaching at the back of the plug illustrated in FIG. 1*a* are four metal leads internally connecting to the metal contacts 101, 106, 108 and 110 respectively. Referring to FIG. 3*b*, which will be described in more detail hereafter, there are four metal wires 306 in the cable connecting to these four leads.

In the above embodiment, without modifying the outer dimension of the conventional audio plug, a hollow cylindrical space is formed in the center of the audio plug. A sufficiently thin and sufficiently wide bandwidth and low-loss coaxial cable is inserted into and fills up the space. The high-speed link is extended from the plug to the jack via an engagement feature in between. The plug portion of the engagement feature is located at the tip of the plug 101 while the receptacle portion, also known as RF connector of the jack, (401 or 501) is located at the jack as described in FIGS. 4*b* and 5*b*.

FIG. 2*a* is a perspective view of a serial electrical connector plug according to another embodiment of the present patent application. FIG. 2*b* is a cross-sectional view of the serial electrical connector plug depicted in FIG. 2*a*. The serial electrical connector plug in this embodiment supports only high-speed/RF signal transmission. Referring to FIGS. 2*a*-2*b*, the serial electrical connector plug in this embodiment is similar to the plug illustrated in FIG. 1*a* except that all low-speed metal contacts and insulators are replaced by a single piece of insulator 205, while the physical dimensions of a conventional TRS or TRRS audio plug can be maintained.

FIG. 2*c* is a perspective view of a serial electrical connector plug according to another embodiment of the present patent application. FIG. 2*d* is a cross-sectional view of the serial electrical connector plug depicted in FIG. 2*c*. Referring to FIGS. 2*c*-2*d*, the serial electrical connector plug is enclosed by a layer of conductive material 206, being connected with the conductive shield of the inner coaxial cable. In general, in the embodiments illustrated by FIGS. 2*a*-2*d*, with the absence of the metal contacts, the allowed inner space for the coaxial cable is larger, thus allowing a thicker coaxial cable to be enclosed. Comparing to the embodiment illustrated in FIGS. 2*a*-2*b*, the embodiment illustrated in FIGS. 2*c*-2*d* allows a thicker coaxial cable.

In the above embodiments, the coaxial cable conforms to the outer dimension of the conventional audio plug. However, all outer circular contacts on the audio plug are removed, replaced by either a single piece of non-conductive and rigid layer (as illustrated in FIG. 2*a*), or a conductive layer (as illustrated in FIG. 2*c*) to maintain the audio plug form factor. As shown in FIG. 2*b*, the conductive layer 203 is in contact with the plug tip 201. Similarly, as shown in FIG. 2*d*, the conductive layer 208 is in contact with the outer conductive shield of the plug 206. They altogether provide shielding for the coaxial cable.

FIG. 3*a* illustrates a connection assembly of an extending cable and a serial electrical connector plug as described in the aforementioned embodiments (only the high-speed/RF part is shown). FIG. 3*b* is a cross-sectional view of the extending cable taken along the line C-C of FIG. 3*a*. Referring to FIG. 3*a*, the coaxial cable embedded in the serial electrical connector plug is extended from the plug engagement feature, being attached to the extending cable, and thereby forming a continuous wide bandwidth medium (waveguide) to support high-speed/RF signal transmission. Referring to FIG. 3*b*, the center wire of the extended cable is a coaxial cable, which includes a core metal 302, an insulator or dielectric layer 303, a metal shielding layer 304, and a coaxial cable jacket 305. The four wires 306 the coaxial cable around are low-speed signal wires. The coaxial cable of the extended cable is connected with the coaxial cable of the connector plug. The metal contacts of the connector plug are connected with the low-speed signal wires of the extended cable.

It is understood that each of the two ends of the extending cable may be connected with a serial electrical connector plug. The outer surface of the cable is enclosed by the outer jacket 301.

FIG. 4*a* is a perspective view of a serial electrical connector jack configured to be used with the serial electrical connector plug according to another embodiment of the present patent application. FIG. 4*b* is a top cross-sectional view of the serial electrical connector jack depicted in FIG. 4*a*. Referring to FIG. 4*a* and FIG. 4*b*, the whole jack is enclosed by a non-conductive housing 402 and is supported by a supporting feature (structure) 405. Metal contacts 403 is configured to guide electrical signals running on the metal contacts 101, 106, 108 and 110 (in FIGS. 1*a*-1*b*) to the system PCB by engaging with the metal contacts 101, 106, 108 and 110. The extension cable 404, connecting to the RF connector 401, brings the incoming high-speed signal to the high-speed/RF signal handling IC, which is not close to the edge of the system PCB.

In this embodiment, the serial electrical connector jack should be compatible with both conventional audio plug and the serial electrical connector plug in the aforementioned embodiments. There is a RF connector 401 inside the jack. After mated with the plug, it allows the high-speed link (the coaxial cable) to be extended from the plug to the jack. Therefore, there is a mechanism for the system to distinguish which type of the plug, the plugs provided by the aforementioned embodiments or a conventional audio plug, is inserted into the jack. Normally, the jack is attached at the edge of a PCB.

In this embodiment, the coaxial cable is further extended at the back of the jack, so that the other end of the cable can be attached to a different location of the system PCB flexibly. This is suitable for applications in which high-speed signal handling IC is placed far away from the jack.

FIG. 5*a* is a perspective view of a serial electrical connector jack configured to be used with the serial electrical connector plug according to another embodiment of the present patent application. FIG. 5*b* is a top cross-sectional view of the serial electrical connector jack depicted in FIG. 5*a*. In this embodiment, referring to FIG. 5*a* and FIG. 5*b*, there is no extension cable as in the previous embodiment (404 in FIG. 4*b*). An interconnect block 505 is configured for bringing the high-speed/RF signal to the system PCB. As shown in FIG. 5*b*, a small coaxial structure 506 is embedded inside the RF connector 501 and the interconnect block 505. After the high-speed serial electrical connector plug is inserted into the jack, the outer shielding 103 and the plug tip 101 (referring to FIG. 1*b*) are mated with RF connector 501. The coaxial structure 506 extends the high-speed link from the plug to the interconnect block 505, and then down to system PCB.

FIG. 5*c* is a perspective view of interconnect block 505. Referring to FIG. 5*c*, the middle three contacts 504, 507 and 508 are respectively for connecting ground, signal, ground signals that correspond to the high-speed signal connection from the coaxial structure 506. The remaining four contacts 509 are configured for connecting low-speed signals from the serial electrical connector plug.

In this embodiment, the high-speed link is terminated inside the jack. An interconnect block 505 (as in FIG. 5*b*) guides the high-speed signal from the RF connector 501 to the bottom of the jack, where PCB traces in form of transmission lines such as microstrip lines and coplanar waveguides connect to it. The interconnect block also guides low-speed signals from the jack's metal contacts to the PCB. Since high-speed signals suffer from high attenuation on the PCB, this type of jacks are more suitable for applications wherein the high-speed signal handling IC is close to the jack. There is also a possibility to mount the high-speed signal handling IC on the interconnect block, so as to regulate or even re-generate incoming high-speed signals, which have already suffered from high attenuation in the electrical connector plug and coaxial cable.

FIG. 6 is an overview of the coaxial cable inside the serial electrical connector plug in the embodiments depicted in FIGS. 1*a*-1*b* and FIGS. 2*a*-2*d*. FIG. 7*a* is a plot of the characteristic impedance of the coaxial cable versus the core conductor diameter, when the diameter of the dielectric material=0.2 mm. FIG. 7*b* is a plot of the characteristic impedance of the coaxial cable versus the core conductor diameter, when the diameter of the dielectric material=0.6 mm. FIG. 7*c* is a plot of the characteristic impedance of the coaxial cable versus the core conductor diameter, when the diameter of the dielectric material=1.2 mm. FIG. 7*d* is a plot of the characteristic impedance of the coaxial cable versus the core conductor diameter, when the diameter of the dielectric material=1.5 mm. FIG. 7*e* is a plot of the characteristic impedance of the coaxial cable versus the core conductor diameter, when the diameter of the dielectric material=2.5 mm. FIG. 7*f* is a plot of the characteristic impedance of the coaxial cable versus the core conductor diameter, when the diameter of the dielectric material=3.5 mm.

It is generally required to match the characteristic impedance of transmission lines, including coaxial cables, to 50 ohm. To achieve this, the embedded coaxial cable to be used in the above embodiments must meet the following design requirements. Simulation results are shown in FIGS. 7*a*-7*f*. Numbers on the graph legend represent different dielectric constant of the coaxial cable dielectric material (104 in FIG. 1*b*, 204 in FIG. 2*b*, 209 in FIG. 2*d*, 303 in FIG. 3*b*). FIG. 6 illustrates the definition of the core diameter and the dielectric diameter.

The aforementioned design requirements are:

1. If the dielectric diameter is equal or smaller than 1.2 mm, the core metal wire diameter should be no bigger than 0.5 mm. This applies to the serial electrical connector plug depicted in FIGS. 1*a*-1*b*.

2. If the dielectric diameter is in the range of 1.2 to 2.5 mm, the core metal wire diameter should be in the range of 0.5 to 1.1 mm.

3. If dielectric diameter is in the range of 2.5 to 3.5 mm, the core metal wire diameter should be in the range of 1.1 to 1.6 mm.

4. The dielectric constant of the dielectric material should be 4.0 or below.

5. The loss tangent (or dissipation factor) of the dielectric material should be kept as low as possible.

The "high-speed signal" in the above embodiments means electrical digital signal with data rate of 5 Gbps or above. However, data rate lower than 5 Gbps also needs to be supported, although this does not fall into the intended range of data rate. The "high-speed/RF signal" in the above embodiments is not limited to unidirectional signals, and may also be bi-directional. The bi-directional signal transmission can be realized by various methods such as the time-division-multiplexing (TDM) technique and the code-division-multiplexing (CDM) method.

In the above embodiments, form factors of standard 2.5 mm and 3.5 mm TRS or TRRS type audio plugs and jacks used in mobile devices nowadays are the targets to implement. TRS is "Tip-Ring-Sleeve", while TRRS is "Tip-Ring-Ring-Sleeve". They define audio plug-jack pairs with three and four metal contacts respectively. Signals running on these contacts are of the low-speed types, which can be audio signals, power supply signals, system control signals, and etc. The low-speed and high-speed signals are running independently in the aforementioned embodiments.

In the above embodiments, the conventional audio plug is combined with the coaxial cable to allow both high-speed and low-speed data transmission at the same time. In other words, the embodiments allow high-speed and low-speed data transmission paths co-exist in a single piece of plug, cable and receptacle. This provides the possibility to unify existing connectors and cables for peripheral connections into one. The above embodiments can be applied to any applications wherein the conventional 2.5 mm and 3.5 mm audio connectors are applicable. The embodiments can help to extend existing products to support high-speed data transmission without having to add additional connectors. Not only in audio applications, the embodiments can be applied to any applications that may need hybrid low-speed and high-speed connections.

While the present patent application has been shown and described with particular references to a number of embodiments thereof, it should be noted that various other changes or modifications may be made without departing from the scope of the present invention.

What is claimed is:

1. A serial electrical connector comprising:

a connector jack; and a connector plug; wherein the connector plug comprises:

an audio plug comprising a tip, an end opposite to the tip, and a hollow cylindrical space formed throughout a center of the audio plug;

a coaxial cable being inserted into and filling the hollow cylindrical space; and an engagement element being disposed at the tip of the audio plug and configured to electrically connect the audio plug to the connector jack;

wherein the coaxial cable extends from the tip of the audio plug to the end of the audio plug.

2. The serial electrical connector of claim 1, wherein the coaxial cable comprises a conductor, an insulator layer surrounding the conductor, and a conductive shield surrounding the insulator layer; and wherein each of the conductor, the insulator layer and conductive shield extends from the tip of the audio plug to the end of the audio plug; and an end of the conductor exits from the hollow cylindrical space.

3. The serial electrical connector of claim 2, wherein the connector plug further comprises at least three metal contacts surrounding the coaxial cable, wherein one of the metal contacts is physically connected with the conductive shield of the coaxial cable.

4. The serial electrical connector of claim 3, wherein the connector plug comprises four metal contacts surrounding the coaxial cable, the four metal contacts corresponding respectively to "tip", "ring, "ring" and "sleeve" of a standard TRRS audio plug structure.

5. The serial electrical connector of claim 1, wherein the connector plug further comprises a non-conductive housing surrounding the coaxial cable.

6. The serial electrical connector of claim 2, wherein the connector plug further comprises a layer of conductive material surrounding the coaxial cable, the layer of conductive material being in contact with the conductive shield of the coaxial cable.

7. The serial electrical connector of claim 1, wherein the connector jack is enclosed by a non-conductive housing and is supported by a supporting structure.

8. The serial electrical connector of claim 3, wherein the connector jack comprises a plurality of metal contacts configured for engaging with the metal contacts of the connector plug respectively.

9. The serial electrical connector of claim 8, wherein the connector jack further comprises an extension cable, the extension cable being connected with the coaxial cable in the connector plug.

10. The serial electrical connector of claim 8, wherein the connector jack comprises an interconnect block and a RF connector, a coaxial structure being embedded inside the interconnect block, the coaxial structure being configured for engaging with the RF connector and being electrically connected with the coaxial cable inside the serial electrical connector.

11. A connection assembly comprising:

an extending cable;

a serial electrical connector plug attached to an end of the extending cable; wherein:

the connector plug comprises an audio plug which comprises a tip, an end opposite to the tip, and a hollow cylindrical space formed throughout a center of the audio plug;

a coaxial cable being inserted into and filling the hollow cylindrical space; and an engagement element being disposed at the tip of the audio plug and configured to electrically connect the audio plug to a connector jack and wherein the coaxial cable extends from the tip of the audio plug to the end of the audio plug; and the coaxial cable is connected to the extending cable forming a continuous waveguide.

12. The connection assembly of claim 11, wherein the extended cable comprises a coaxial cable in the center and at least three wires surrounding the coaxial cable, the coaxial cable of the extended cable being connected with the coaxial cable of the connector plug.

13. The connection assembly of claim 12, wherein the connector plug further comprises at least three metal contacts surrounding the coaxial cable thereof, the metal contacts of the connector plug being connected with the wires of the extended cable.

14. The connection assembly of claim 12, wherein the coaxial cable of the extended cable comprises a core metal, an insulator or dielectric layer surrounding the core metal, a metal shielding layer surrounding the insulator or dielectric layer, and a coaxial cable jacket surrounding the shielding layer.

15. A serial electrical connector plug comprising:

an audio plug comprising a tip, an end opposite to the tip, and a hollow cylindrical space formed throughout a center of the audio plug;

a coaxial cable being inserted into and filling the hollow cylindrical space; and an engagement element being disposed at the tip of the audio plug and configured to electrically connect the audio plug to a connector jack;

wherein the coaxial cable extends from the tip of the audio plug to the end of the audio plug.

16. The serial electrical connector plug of claim 15 further comprising at least three metal contacts surrounding the coaxial cable, wherein the coaxial cable comprises a conductor, an insulator layer surrounding the conductor, and a conductive shield surrounding the insulator layer.

17. The serial electrical connector plug of claim 16, wherein one of the metal contacts is physically connected with the conductive shield of the coaxial cable.

18. The serial electrical connector plug of claim 16 further comprising four metal contacts surrounding the coaxial cable, wherein the four metal contacts correspond respectively to "tip", "ring, "ring" and "sleeve" of a standard TRRS audio plug structure.

19. The serial electrical connector plug of claim 15 further comprising a non-conductive housing surrounding the coaxial cable.

20. The serial electrical connector plug of claim 16 further comprising a layer of conductive material surrounding the coaxial cable, wherein the layer of conductive material is in contact with the conductive shield of the coaxial cable.

* * * * *